United States Patent [19]

DeCorso

[11] 4,112,676

[45] Sep. 12, 1978

[54] HYBRID COMBUSTOR WITH STAGED INJECTION OF PRE-MIXED FUEL

[75] Inventor: Serafino M. DeCorso, Upper Providence Township, Delaware County, Pa.

[73] Assignee: Westinghouse Electric Corp., Pittsburgh, Pa.

[21] Appl. No.: 784,754

[22] Filed: Apr. 5, 1977

[51] Int. Cl.[2] ..... F02C 7/22

[52] U.S. Cl. ..... 60/39.71; 60/39.74 R; 431/10

[58] Field of Search ..... 60/39.71, 39.74 R, 39.74 B; 431/10

[56] References Cited

U.S. PATENT DOCUMENTS

| | | | |
|---|---|---|---|
| 2,621,477 | 12/1952 | Powter et al. | 60/39.71 |
| 2,955,420 | 10/1960 | Schirmer | 60/39.71 |
| 3,946,553 | 3/1976 | Roberts et al. | 60/39.74 R |
| 4,052,844 | 10/1977 | Caruel et al. | 60/39.71 |

*Primary Examiner*—Robert E. Garrett
*Attorney, Agent, or Firm*—F. A. Winans

[57] ABSTRACT

A combustor for a gas turbine engine which includes a fuel nozzle at the head end of the combustor, to provide a diffusion flame, and downstream inlet means at a plurality of axial dimensions of the combustor to inject pre-mixed lean fuel/air into the combustor for admission downstream from the diffusion flame resulting in a series of low temperature premixed flames to provide relatively high turbine inlet temperatures from the combustor with a minimum of thermally formed NOx compounds.

6 Claims, 2 Drawing Figures

HYBRID COMBUSTOR WITH STAGED INJECTION OF PRE-MIXED FUEL

BACKGROUND OF THE INVENTION

1. Field of the Invention

The invention relates to a combustor for a gas turbine engine and more particularly to a combustor having a plurality of axially staged pre-mixed fuel/air inlets and a piloting flame of the diffusion type at its head end.

2. Description of the Prior Art

It has become increasingly important, because of the national energy conservation policies and also because of increasing fuel expense, to develop gas turbine engines having a relatively high thermal conversion efficiency.

It is a known principle of the gas turbine engine that an increase of thermal efficiency can be accomplished by increasing the turbine inlet temperatures and pressures. However, it is also recognized that increasing the turbine inlet temperature in turn increases the production of certain noxious exhaust pollutants. Of principal concern is the emission of oxides of nitrogen.

The sources of the nitrogen for forming the nitrogen oxides (particularly NO and $NO_2$ and subsequently identified as NOx) is the nitrogen in the fuel and generally identified as fuel bound nitrogen and the nitrogen present in the combustion air. Reduction of fuel bound nitrogen generally requires a pre-treatment of the fuel to reduce the nitrogen content, which can be prohibitively expensive. Thus, to enable the high temperature gas turbines of the future to meet the proposed NOx emission standards it is necessary to minimize the NOx attributable to formation from nitrogen in the combustion air during the combustion process.

It is recognized that NOx formed from the combustion air is significantly influenced by the flame temperature and the residence time of the nitrogen at such temperature. In the present state of the art, diffusion flame type combustors of large gas turbine engines (i.e., wherein fuel is introduced into the combustion chamber through a fuel nozzle for atomization and mixture with air within the chamber just prior to combustion) the combustion of the fuel/air mixture produces adiabatic flame temperatures of from 3100° F to 4300° F. (The flame temperature of both liquid and gaseous fossil fuels come within this temperature range.) Although the hot combustion gas products are mixed with air for quenching the temperature of the gas products to a lower temperature, the existence of such high temperatures at the diffusion flame front is sufficient to produce an unacceptable amount of NOx.

Further, as the relationship between the production of NOx and the temperature is generally an exponential relationship, any reduction in the flame temperature for the same residence time, significantly reduces NOx production. Further, since there exists a finite time increment necessary to complete the combustion process, which is on the order of a few milliseconds, NOx reduction through a decrease in the residence time is limited to the point where appreciable CO and unburned hydrocarbon levels appear in the exhaust. Insofar as most gas turbine combustion systems are concerned, residence times already hover around this minimum value, and thus the only remaining alternative to obtain significant reduction in NOx formation is to lower the combustion flame temperature.

Previous methods of lowering flame temperature are to inject steam or water into the flame or circulate a coolant in pipes to the flame front. However, each method has obvious inefficiencies and mechanical problems. Thus, a significant reduction in NOx production requires that the diffusion flame process of the present combustors, with its attendant high flame temperature NOx generation, be modified to develop a lower temperature combustion flame. U.S. Pat. No 3,973,390 and U.S. Pat. No. 3,973,395 are somewhat pertinent to this concept, however in each instance a vaporized fuel rich mixture is introduced into a combustion zone for mixture with air therein prior to burning as ignited by a pilot flame. And, at such high temperature conbustion, the speed of ignition exceeds the ability to mix such that fuel rich burning occurs, still resulting in an unacceptable level of thermally produced NOx.

SUMMARY OF THE INVENTION

The basic approach of the present invention is to alter the concentration of reactants available to the NOx formation process and yet produce a turbine inlet temperature sufficiently high (i.e., up to 2500° F) to improve the thermal efficiency of the turbine. Thus, according to the present invention a lean fuel/air mixture is obtained by providing multiple fuel sources followed by a high velocity mixing zone prior to introduction into, and ignition within, the combustor. This reduces fuel/air gradients resulting in a lower peak flame temperature and thereby provides low NOx production. However, to introduce sufficient fuel in generally one location within the combustor to obtain a turbine inlet temperature of approximately 2500° F may require the pre-mixed mixture to become sufficiently rich to have a flame temperature having a high NOx production zone. Thus, the invention also includes a plurality of separate axially spaced locations for introduction of the lean pre-mixed fuel/air mixture such that as the mixture in an upstream location becomes rich enough to provide a flame temperature corresponding to a steep portion of the exponential curve in the temperature/NOx production relationship, the next downstream pre-mixed air/fuel mixture is introduced which upon combustion raises the temperature of the combustion gases but maintains the flame temperature in a region of relatively low NOx production.

The main problem of combustion via lean pre-mixed fuel/air is maintaining combustion (i.e., flame stability) during low temperature conditions such as start-up or turn-down of the turbine. Thus the present invention also includes a conventional diffusion-flame type burner (i.e., nozzle with atomizing air inlets) at the head end of the combustor wherein a small portion of fuel is injected and burned in a fuel rich zone to provide hot gases to act as the continuous pilot for igniting the lean downstream mixtures and provide flame stability during operation including start-up.

The combustor of the present invention thus essentially comprises two types of combustion, i.e., conventional diffusion and molecular pre-mixed combustion with the pre-mixed air/fuel being injected at distinct axial stages through the combustor, hence the characterization of the invention as a hybrid combustor with staged injections of a pre-mixed fuel. (It is understood that premixed merely means that fuel and air have been intimately mixed, on a molecular level, before combustion; so that burning occurs at a relatively low temperature.)

DESCRIPTION OF THE PREFERRED EMBODIMENT

Figure 1:
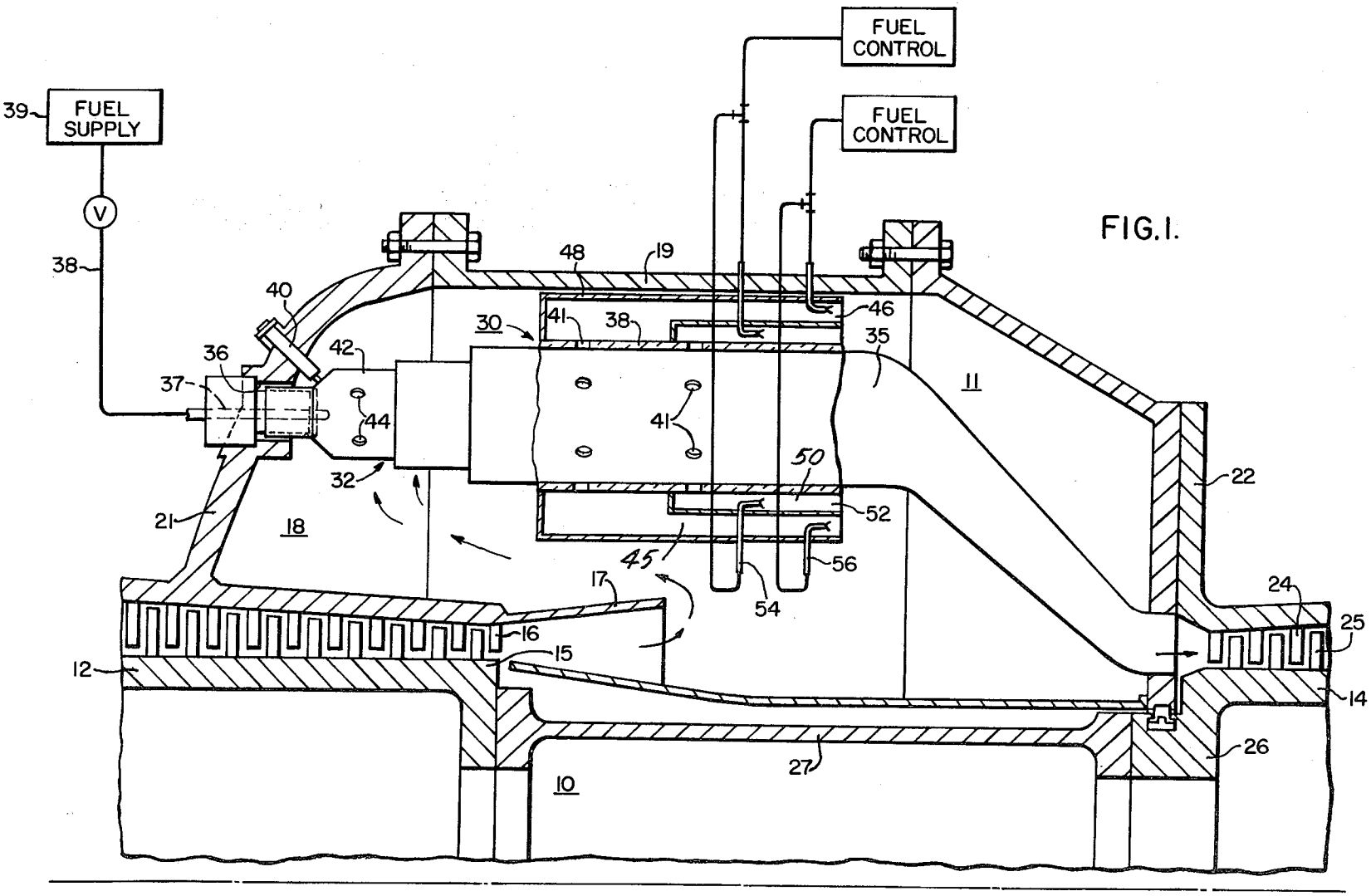
FIG. 1 is an axial sectional view of that portion of a gas turbine engine housing combustion apparatus incorporating the present invention; and, FIG. 2 is a graph illustrating typical NOx level production plotted against the turbine inlet temperature.

Referring to FIG. 1 there is shown a portion of a gas turbine engine 10 having combustion apparatus generally designated 11. However, the combustion apparatus may be employed with any suitable type of gas turbine engine. The gas turbine engine 10 includes an axial flow air compressor 12 for directing air to the combustion apparatus 11 and a gas turbine 14 connected to the combustion apparatus 10 and receiving hot products of combustion air from for motivating the turbine.

Only the upper half of the turbine and combustion apparatus has been illustrated, since the lower half may be substantially identical and symmetrical about the centerline of axis of rotation RR' of the turbine.

The air compressor 12 includes, as well known in the art, a multi-stage bladed rotor structure 15 cooperatively associated with a stator structure having an equal number of multi-stage stationary blades 16 for compressing the air directed therethrough to a suitable pressure for combustion. The outlet of the compressor 12 is directed through an annular diffusion member 17 forming an intake for the plenum chamber 18, partially defined by a housing structure 19. The housing 19 includes a shell member of generally circular cross-section, and as shown in FIG. 1 is of generally cylindrical shape, parallel with the axis of rotation R–R' of the gas turbine engine, a forward dome-shaped wall member 21 connected to the external casing of a compressor 12 and a rearward annular wall member 22 connected to the outer casing of the turbine 14.

The turbine 14 as mentioned above is of the axial flow type and includes a plurality of expansion stages formed by a plurality of rows of stationary blades 24 cooperatively associated with an equal plurality of rotating blades 25 mounted on the turbine rotor 26. The turbine rotor 26 is drivingly connected to the compressor rotor 15 by a shaft member 27, and a tubular liner member 28 is suitably supported in encompassing stationary relation with the connecting shaft to provide a smooth air flow surface for the air entering the plenum chamber 18 from the compressor diffuser 17.

Disposed within the housing 19 are a plurality of tubular cylindrical combustion chambers or combustors 30. The combustion chambers 30 are disposed in an annular mutually spaced array concentric with the centerline of the power plant as is well known in the art. However, since each combustor is identical only one will be described. Thus, each combustor 30 is comprised of generally three sections: an upstream primary section 32; an intermediate secondary portion 33 and a discharge end 35 leading to a downstream transition portion 34 having a dogleg contour leading to the turbine nozzle.

The head end 21 of the housing 19 is provided with an opening 36 through which a fuel injector 37 extends. The fuel injector 37 is supplied with fuel by a suitable conduit 38 connected to any suitable fuel supply and control 39 and the injector 37 may be of the well-known atomizing type so as to provide a substantially conical spray of fuel within the primary portion 32 of the combustion chamber 30. A suitable electrical igniter 40 is provided for igniting the fuel and air mixture in the combustor 30. In the primary portion 32 of the combustor 30 are a plurality of liner portions 42 of circular cross-section and in the example shown, the liner portions are cylindrical. The portions 42 are of stepped construction, i.e., each of the portions has a circular section of greater circumference or diameter than the preceding portion from the upstream to the intermediate portion to permit telescopic insertion of the portions. The most upstream portion 42 has an annular array of apertures 44 for admitting primary air from within the plenum chamber 18 into the primary portion 32 of the combustor to support diffusion combustion of the fuel injected therein by the fuel injector 37.

In accordance wih this invention, the intermediate axial section 33 of the combustion chamber comprises a ceramic cylindrical shell 38 concentric with, and attached to, the upstream cylindrical section 32 and the discharge section which in turn exhausts into the transition duct 34. The ceramic wall 38 defines a plurality of axially spaced rows of apertures 40, 42 (in the embodiment shown in FIG. 1, there are two such rows).

A first mixing chamber of duct 45 is defined by an annulus having a downstream facing open end 46 for receiving compressed air from the plenum chamber with the upstream end 48 in closed flow communication with the upstream row of apertures 40 in the ceramic cylinder 38. A second mixing chamber or annular duct 50 is defined by another annulus also having a downstream facing open end 52 for receiving compressed air from the plenum chamber with its upstream end 54 in closed flow communication with the next downstream row of apertures 42 in the ceramic cylinder 38. As shown, each duct 45, 50 encircles each combustor chamber about the axis of the chamber; however, it is contemplated that each duct could be annular about the axis of the engine and provide a closed flow communication between the plenum 18 and any number of individual combustion chambers in the gas turbine engine.

Each duct encloses fuel injecting means 54, 56 generally adjacent the open ends 46, 52 thereof for injecting fuel into the compressed air flowing through the headers. The flow path of the fuel/air mixture through the ducts, through the respective apertures 40, 42 and into the intermediate portion 33 of the combustion chamber provides a path sufficient to completely mix the air-fuel to a homogenous molecular mixture. Thus, a plurality of pre-mixed air/fuel mixtures are introduced to the combustion chamber at separate axially distinct locations immediately downstream of the primary diffusion flame for ignition thereby.

The fuel injection means 54, 56 to each duct 45, 50 and the fuel nozzle 37 at the head end of the combustor are all controlled in a manner that permits individual regulation at each location and the introduction of different fuels depending upon the circumstances. The stepped liner configuration of the upstream cylindrical portion 32 provides a film of cooling air for maintaining this portion within acceptable temperature limits. However, in that the intermediate portion is enclosed by the headers and not available for film cooling, the ceramic material permits operation of this section within elevated temperature ranges that do not require cooling. Further, the use of a ceramic wall produces a wider range of combustor flame stability and reduces CO emissions, because of the hot walls of the ceramic structure.

Figure 2:
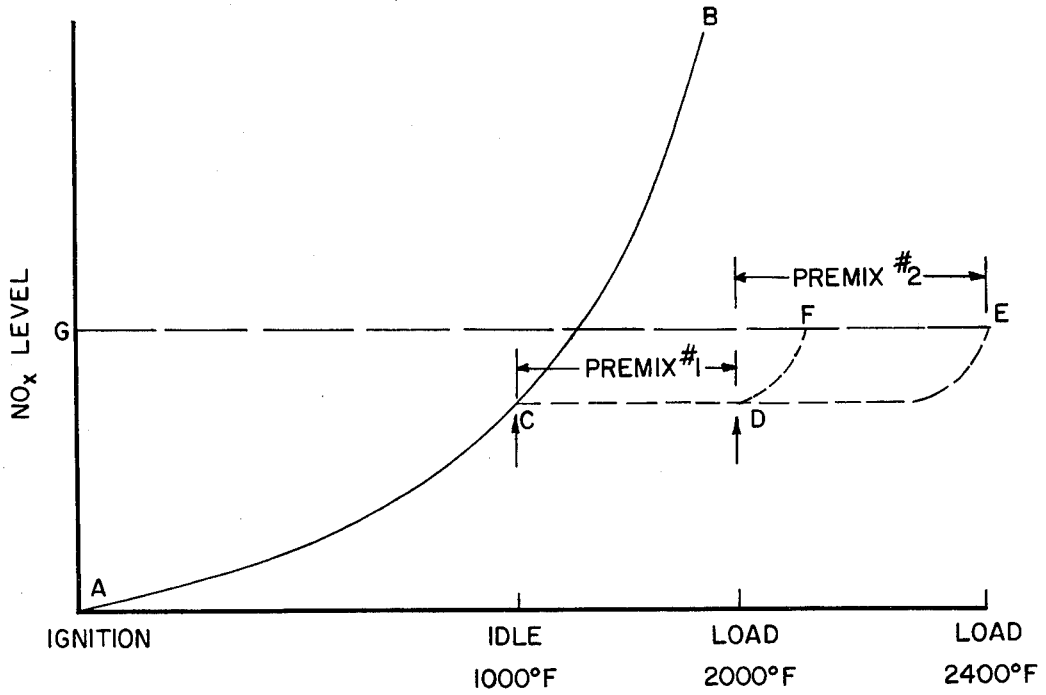

Referring now to FIG. 2, the contemplated operation of the above-described combustor is described in relation to a typical NOx production vs. turbine inlet temperature curve. Thus, driving start-up (i.e. initiating at ignition of the diffusion flame) and continuing up to the turbine idle speed (wherein the turbine inlet temperature is in the range of 1000° F) the head end diffusion flame in the primary zone 32 provides the sole combustion, which provides a highly controllable operation as presently provided by common diffusion flame combustors. However, the curve AB representing typical NOx production in a diffusion flame has a relatively steep portion at this 1000° F range and as is seen rapidly approaches a projected EPA regulation for limiting such emission. Thus, at the 1000° F range (point C) fuel to the duct 44 is turned on to initiate a lean fuel flame downstream of the diffusion flame. This fuel/air mixture, being a molecular mixture, does not provide any hot pockets of combustion which would promote NOx production, and therefore provides a flat line CD representing no increase in NOx production, up to approximately 2000° F. However, with the fuel mixture becoming increasingly rich, at this point further injection of fuel to a single area in the combustor would start to produce areas of concentrated fuel having flame temperatures capable of producing NOx, which if continued, would follow the projected curve DF and again rapidly exceed the projected EPA regulations. To avoid this, no increase in fuel is introduced into the duct 44 so that the actual flame temperature threat does not exceed about 3000° F and fuel is initiated into duct 50 to repeat the process. Again, the molecular fuel/air mixture provides a flame front of relatively even temperatures that do not approach the range of thermally produced NOx (i.e. 3000° F) until the fuel is increased to provide a turbine inlet temperature of about 2400° F at a full load condition. At this point the flame temperature again produces NOx in a manner similar to the diffusion flame; however full load is achieved with the NOx production below acceptable projected limitations.

I claim:

1. A combustion apparatus for a gas turbine engine comprising: a combustion chamber having, in the direction of fluid flow therethrough, a head end, an intermediate portion, and a discharge end; a first fuel injecting means for discharging fuel into said head end; air inlet means in said head end providing combustion air for said fuel; ignition means for igniting said fuel/air mixture in said head end for diffusion burning; and, means for introducing pre-mixed fuel and air into said chamber downstream of said diffusion burning, said last-named means comprising:

a first duct means having an open inlet end for receiving compressed air and providing confined flow communication therefrom to within the intermediate portion of said combustion chamber at one axial location thereof, said first duct generally enclosing fuel injecting means adjacent its open end for injecting fuel into the air flowing therethrough for pre-mixing prior to entry into said combustion chamber;

at least a second duct means having an open inlet end for receiving compressed air and providing confined fluid flow communication therefrom to within the intermediate portion of said chamber at a separate axial location downstream of said one axial location, said second duct generally enclosing fuel injecting means adjacent its open end for injecting fuel into the air flowing therethrough for pre-mixing prior to entry into said chamber; and, means for independently controlling the rate of fuel flow to each of said fuel injecting means.

2. Combustion apparatus according to claim 1 wherein both said first and second ducts are substantially annular and concentric about the axis of said combustion chamber and with the flow from each duct discharging into said intermediate portion through an array of apertures at distinct axial positions in said combustion chamber.

3. Combustion apparatus according to claim 2 wherein the wall of said intermediate portion of said combustion chamber is ceramic to permit an uncooled wall portion for enhancing flame stability of the combustion within said portion.

4. Combustion apparatus according to claim 3 wherein the fuel is gradually introduced serially into said chamber with the head fuel injecting means initially receiving fuel for diffusion burning and said fuel injecting means in said first duct receiving fuel only after the temperature of said diffusion burning approaches an upper acceptable limit and said fuel injecting means in said second duct receiving fuel only after the temperature of the flame at said upstream axial position approaches a greater upper acceptable limit.

5. A gas turbine engine comprising a compressor for compressing and discharging air into a plenum chamber, a turbine driven by a motive fluid, and a combustion chamber disposed in said plenum chamber and directing the products of combustion to said turbine as the motive fluid, said combustion chamber comprising a generally cylindrical member having, in the direction of fluid flow therethrough, a head end having a first fuel injecting means for discharging fuel into said chamber and air inlet means for mixing with said fuel in said chamber to support combustion, an axially extending intermediate portion, a discharge end for directing the combustion products to said turbine, and further including:

at least a first and second duct means, with each duct means providing a confined flow path between said plenum chamber and the combustion chamber through apertures at distinct axial positions in said intermediate portion, both duct means being annularly disposed about said combustion chamber and having one end open to said plenum chamber and the other end enclosing said apertures in said intermediate portion;

means within each duct adjacent the open end for injecting fuel into the air entering said duct for mixture therewith to provide a pre-mixed air and fuel mixture to said combustion chamber; and, means for controlling the rate of fuel flow to each fuel injecting means whereby fuel is initially introduced at said upstream portion for gradually increasing the turbine inlet temperature to a certain value generally associated with turbine idle speed and then fuel is introduced into said first duct means for combustion within said intermediate portion at an upstream position to increase the turbine inlet temperature to a value associated with a partially loaded condition and finally fuel is introduced to said second duct means for combustion in said intermediate portion at a downstream position to increase the turbine inlet temperature to a value associated with a fully loaded condition of said turbine.

6. A gas turbine according to claim 5 wherein the wall of said intermediate portion of said combustion chamber is ceramic to permit an uncooled wall portion for enhancing flame stability of the combustion within said portion.

* * * * *